US005954293A

United States Patent [19]

Luigi et al.

[11] Patent Number: 5,954,293

[45] Date of Patent: Sep. 21, 1999

[54] CADDY FOR MAINTAINING PACKAGES AND TUBES IN AN ERECT POSITION FOR THEIR TRANSPORT AND POSITIONING WITHIN TEXTILE MACHINES

[75] Inventors: Piva Luigi, Fiume Veneto; Antoniel Maurizio, Pordenone; Bertoli Luciano, Fiume Veneto, all of Italy

[73] Assignee: Savio Macchine Tessili S.p.A., Pordenone, Italy

[21] Appl. No.: 08/965,793

[22] Filed: Nov. 7, 1997

[30] Foreign Application Priority Data

Nov. 22, 1996 [IT] Italy ..... MI96A2436

[51] Int. Cl.[6] ..... B65H 54/02; B65H 49/02; D01H 9/10

[52] U.S. Cl. ..... 242/578.2; 57/281; 242/130

[58] Field of Search ..... 242/571.5, 578, 242/578.2, 578.3, 597.7, 130, 130.3, 130.4, 474.1, 470; 57/281

[56] References Cited

U.S. PATENT DOCUMENTS

| | | | |
|---|---|---|---|
| 1,762,516 | 6/1930 | Hlavac . | |
| 2,623,710 | 12/1952 | Pearson . | |
| 2,915,260 | 12/1959 | Parrott . | |
| 3,744,735 | 7/1973 | Koenig | 242/130 |
| 4,050,649 | 9/1977 | Haag | 242/571.5 X |
| 4,634,077 | 1/1987 | Wilson | 242/130 X |
| 4,928,903 | 5/1990 | Wirtz et al. | 242/130 |
| 5,245,816 | 9/1993 | Mima | 57/281 |
| 5,297,671 | 3/1994 | Ruth . | |
| 5,390,868 | 2/1995 | Kiriake | 242/470 |
| 5,535,956 | 7/1996 | Irmen | 57/281 X |

FOREIGN PATENT DOCUMENTS

| | | |
|---|---|---|
| 6 508 258 | 8/1965 | Netherlands . |
| 415 402 | 1/1967 | Switzerland . |
| 444291 | 3/1936 | United Kingdom . |
| 1266578 | 3/1972 | United Kingdom . |
| 1383775 | 2/1975 | United Kingdom . |

OTHER PUBLICATIONS

Patent Abstracts of Japan, vol. 096, No. 12; JP 08 198524, Dec. 12, 1996.

*Primary Examiner*—Michael Mansen
*Attorney, Agent, or Firm*—Kramer, Levin, Naftalis, and Frankel LLP; George P. Hoare, Jr.

[57] ABSTRACT

A caddy for packages having tubes for use in a yarn production process includes a disc-shaped base in which there is coupled a hollow tubular peg about which a package support slider is slidably mounted coaxial to the peg, to offer to the package mounted on the peg a level-adjustable support.

12 Claims, 4 Drawing Sheets

CADDY FOR MAINTAINING PACKAGES AND TUBES IN AN ERECT POSITION FOR THEIR TRANSPORT AND POSITIONING WITHIN TEXTILE MACHINES

FIELD OF THE INVENTION

This invention relates to the handling of packages and tubes within textile yarn preparation machines and in particular to an individual movable support for the transport and positioning of packages having tubes for processing by textile yarn preparation machines.

BACKGROUND INFORMATION

In the known art, considerable favour has been found in the expedient of using caddies to manipulate packages having tubes in the production, control and packaging of yarn from textile fibre sliver. The caddies are located on belt conveyors or similar handling members serving the machine. The caddies individually move the packages and tubes to and from the processing units.

The caddies are provided with a vertical central mandrel which enables the package being carried to be maintained in an erect position not only during transport but also during preparation and unwinding. The packages are transferred and processed without being soiled or deteriorated since only the caddies are handled, and the caddies prevent the packages from contacting the machine members. A caddy is described in numerous documents of the known art, such as French patent 1,571,158 in the name of Giddings and Lewis-Fraser, Japanese No. JP-A-59-12128 in the name of Kanebo and Italian patent application 48,195/A/82 in the name of Murata. A drawback of the caddies of the known art is evident during the unwinding of the package in a bobbin winding machine. In this respect, it should be noted that in winding machines of the most recent design, the unwinding speed is on the order of 25 m/sec and more, with the yarn rotating about the package at a speed of approximately 10,000–20,000 r.p.m.

As a result of the relatively high speeds of rotation, radial stresses are generated which tend to move the package from vertical, and axial stresses are generated which tend to raise the package from the base. These stresses tend to shift the package and caddy from their correct vertically centered position during processing and unwinding, with possible misalignment of the caddy and separation of the package from the caddy mandrel on which it rests. To obviate these drawbacks, elaborate caddy constructions have been proposed which include resilient means for retaining the package on the mandrel and conical lead-in fins for centering the package. Such systems are mentioned in, for example, DE-A-4,236,038 and U.S. Pat. No. 5,297,761 in the name of Schlafhorst and in Italian patent application MI96A125 in the name of the present applicant. These arrangements are not, however, free from drawbacks, especially considering that in a yarn spinning and bobbin winding factory, thousands of caddies may be required for each machine, especially if processing several batches, i.e., dividing the bobbin winding machine by simultaneously using in some of the winding units a yarn different from that used in the other winding units of the same machine.

OBJECTS AND SUMMARY OF THE INVENTION

It is an object of the present invention to provide an improved caddy of more general use free from the drawbacks of the known art.

As can be seen hereinafter, the caddy according to the present invention is advantageously suitable for supporting different sized packages while maintaining them in a constant position relative to the winding machine members and ensuring a yarn end always of constant length on commencing the unwinding of a new package.

To clarify the technical problems confronted and solved by the present invention and its characteristics and advantages compared with the known art, the present invention is described hereinafter with reference to its application to the processing of packages during bobbin winding, by way of non-limiting examples. The present invention therefore relates to an individual caddy for packages having tubes, for their positioning, transport and maintenance of correct position during unwinding in yarn preparation machines.

The characteristics and advantages of the individual transport caddy according to the present invention will be more apparent from the description of some typical embodiments thereof given hereinafter by way of non-limiting example with reference to FIGS. 1A to 4F.

DETAILED DESCRIPTION

Figure 1B:
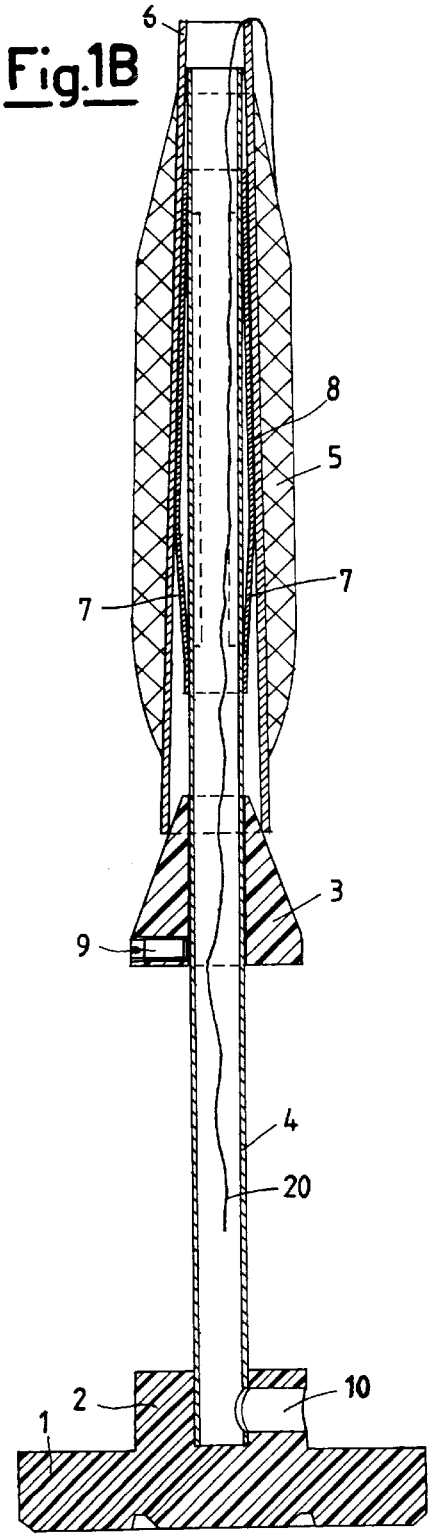
FIG. 1B is a cross-sectional view of an individual transport caddy according to the present invention wherein the caddy is carrying a package which is smaller than that shown in FIG. 1A.
Figure 1A:
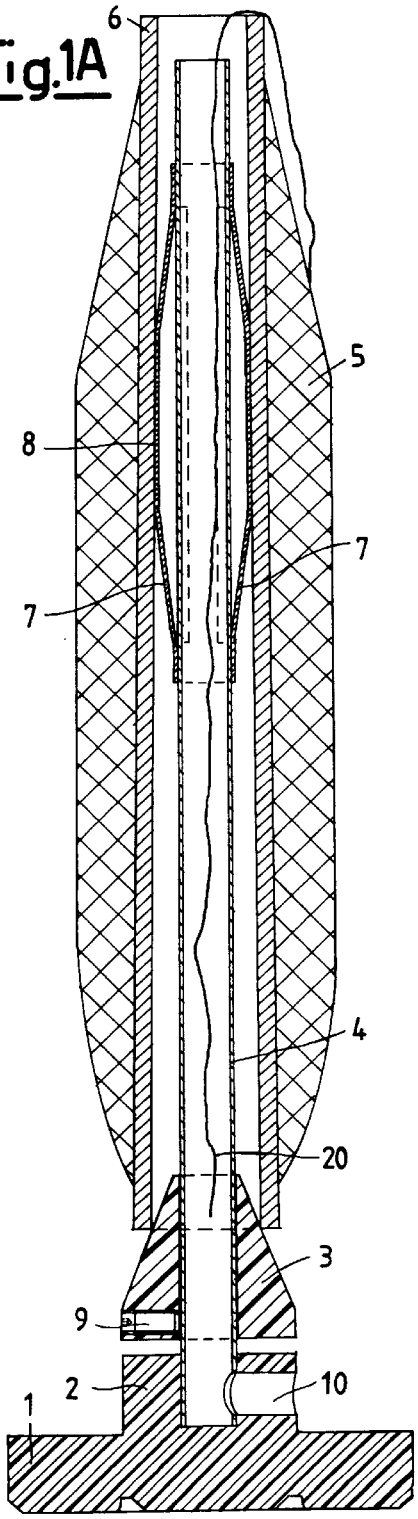
FIG. 1A is a cross-sectional view of an individual transport caddy according to the present invention wherein the caddy is carrying a large-format package.

FIGS. 1A and 1B show one embodiment of an individual transport caddy according to the present invention. FIG. 1A is a sectional view through the caddy carrying a large-format package, and FIG. 1B is a sectional view through the caddy carrying a smaller package. The caddy includes a cylindrical, preferably circular, disc-shaped base 1, upperly carrying a cylindrical collar 2. The lower face of the base 1 is intended to rest on machine transport and service devices, and the upper face of the cylindrical collar 2 acts as a support or limit step for support slider 3 for the tube of the transported package 5. The body of the collar 2 also performs other functions in guiding the caddy along the bobbin winding paths. In the unit formed by the base 1 and collar 2 there is inserted a tubular peg 4 intended to engage the cavity of the tube on which the package is wound. The tubular peg is intended to contain the yarn end of the package after its preparation for unwinding, for example in automatic preparation devices.

The support slider 3 for the package 5 is coaxial with the peg 4. The support slider 3 can slide on peg 4 and then be locked into position thereon so as to offer the package 5 mounted on the peg a support at a level adjustable relative to the tip of the tubular peg 4. The level of the package is adjusted by varying the height of the slider from the caddy base 1. In the embodiments of FIGS. 1A and 1B, the slider is conical in order to exert on the lower end of the package tube 6 an action for centering its lower cavity about the peg 4.

The slider 3 can be fixed at the desired level on the peg 4 by conventional positioning means, for example with a setscrew 9 which screws into and unscrews from a threaded guide hole transverse to the peg 4.

The useful length of the tubular peg 4 is on the whole less than the length of the longest package in the range which is to be processed. It is not necessary for the upper end of the tubular peg 4 to emerge from the top of the package when the package is locked in position thereon. In this respect, the slider 3 is preferably adjusted so that the top of the tube 6 is higher than the end of the peg 4 and at a constant distance therefrom determined by the overlying members of the bobbin winding unit, for example the so-called "balloon breaker" which limits the transverse excursion of the unwinding yarn.

On the upper part of the tubular peg 4 which is to engage the upper part of the tube 6 of the package 5, there are a plurality of spring elements 7, of three or more in number, distributed about the vertical axis of the peg 4, preferably symmetrically thereabout. The spring elements 7 are provided with projections 8 intended to grip the upper part of the inner cylindrical wall of the tube 6. In FIGS. 1A and 1B, the spring elements 7 are each provided with a single projection 8, providing centering of the upper part of the tube 6, centering of the lower part already being ensured by the conical shape of the slider 3. The spring elements 7, preferably constructed of metal such as spring steel, are formed of such cross-sections and shapes as to achieve a transverse dimension at rest which is slightly greater than the inner dimension of the tube 6. As a result, in connection with all available tubes, an elastic deformation of the spring elements 7 occurs when the tube is mounted on the tubular peg 4 to rest on the slider 3, in order to ensure both that the package 5 is centered and that the forces which would tend to shift the package during unwinding are counteracted. This type of construction enables a centered and correct position to be maintained even for tubes which are of considerably different diameters and lengths, by simply adjusting the positioning level of the slider when using tubes which have to rest at a different height.

The further figures from 1C to 1F illustrates by way of non-limiting example, some examples of the connection between the tubular peg 4 and the spring elements 7. The lower part of the caddy comprising the base disc 1 and the collar 2, plus the slider 3, can be constructed of plastic material, whereas the tubular peg 4 can be formed from a metal tube, such as steel.

Figure 1C:
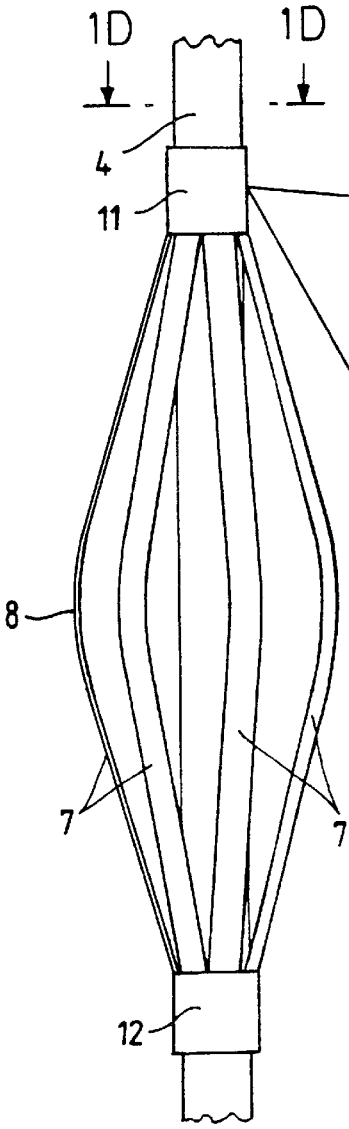
FIG. 1C is a side view of the individual transport caddy according to the present invention showing the coupling of spring elements to an upper tubular collar and a lower tubular collar.
Figure 1E:
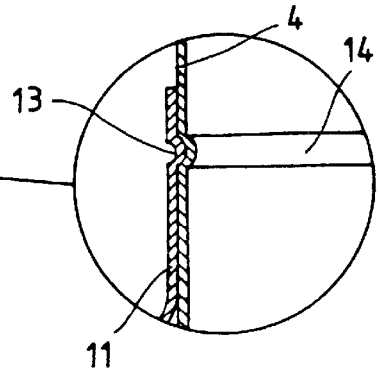
FIG. 1E is an enlarged view of the structure of the upper collar of the transport caddy.
Figure 1F:
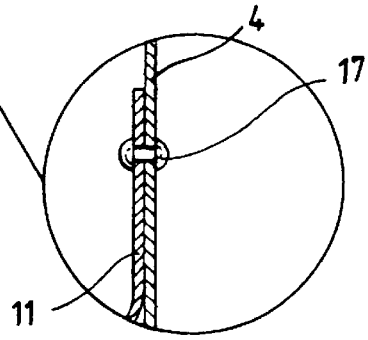
FIG. 1F is an enlarged view of the coupling of the spring elements to the upper tubular collar.
Figure 1D:
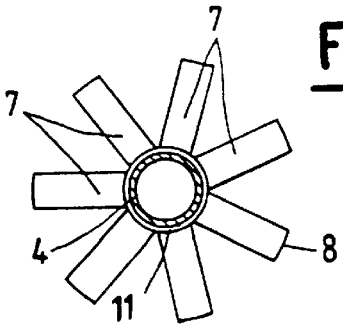
FIG. 1D is a top view taken along line 1D—1D of FIG. 1C.

In the embodiment shown in FIGS. 1C and 1D which represent a side view and a top section thereof, the spring elements 7 are joined together at their ends to the peg 4 by an upper tubular collar 11 and a lower tubular collar 12, of inner diameter such as to slide along the peg as an exact fit with tube 6 which is provided thereover, forming a cage which retains the tube. This cage is fixed to the tubular peg 4 at a predetermined height, which generally must not be changed during the technical life of the caddy. The deformation of the springs 7 by the tubes put on them causes the springs to undergo a significant excursion along the peg 4, the fixing hence being such as to allow the springs 7 this excursion freedom.

In the detailed section of FIG. 1E, the spring cage is fixed by a horizontal circular projection 13 in the inner perimeter of the upper collar 11. The horizontal circular projection is designed to restrict passage over the tubular peg 4. A horizontal circular groove 14 is provided in the outer perimeter of the upper collar 11 so as to engage projections 13, this corresponding to a positioning height for the springs 7 on the peg 4. The projection 13 is inserted into the groove 14, for example by forcing it under hot conditions. In other words, the spring cage is fixed by being force fit between projections 13 and grooves 14 provided on one of the collars and in the tubular peg 4, at a height corresponding to the positioning of the springs 7 on the peg 4.

As can be seen, the lower collar 12 can slide freely along the peg 4 when the springs 7 are compressed and released.

In the detailed section of FIG. 1F, the spring cage 7 is fixed to the peg 4 by one or more rivets 17 applied to the perimeter of the upper collar 11, the collar 12 not being restrained in its excursion along the peg.

The outer transverse dimension of the tubular page 4 must also be coherent with the size of the tubes to be received and supported. Generally it must have an outer diameter less than the smallest inner diameter scheduled for the tubes of the packages to be processed while also leaving the space required for the useful transverse travel of the springs 7 which expand and compress according to the constriction exercised by the tube mounted over them.

In the same manner, the transverse dimension of the slider 3 must also be coherent with the diameter of the tubes to be centered and supported. Generally, the outer diameter of the lower part of the slider must be substantially greater than the largest inner diameter of the tubes 6 of the packages 5 to be processed. The outer diameter of the upper part of the slider should be substantially less than the smallest inner diameter scheduled for the tubes of the packages to be processed, so that in all cases the tubes rest on its conical part of the slider. Service air, both drawn and blown, passes through the interior of the tubular peg 4 from the top of the tube to its base. For this purpose, in the embodiment shown in FIGS. 1A and 1B, the lower outlet of the passage is provided in the cylindrical face of the collar 2, by means of a horizontal hole 10. In an alternative embodiment of FIG. 2, the lower outlet of the air passage is provided, for example, in the lower face of the disc 1, with the hole 21 passing vertically therethrough.

Figure 3:
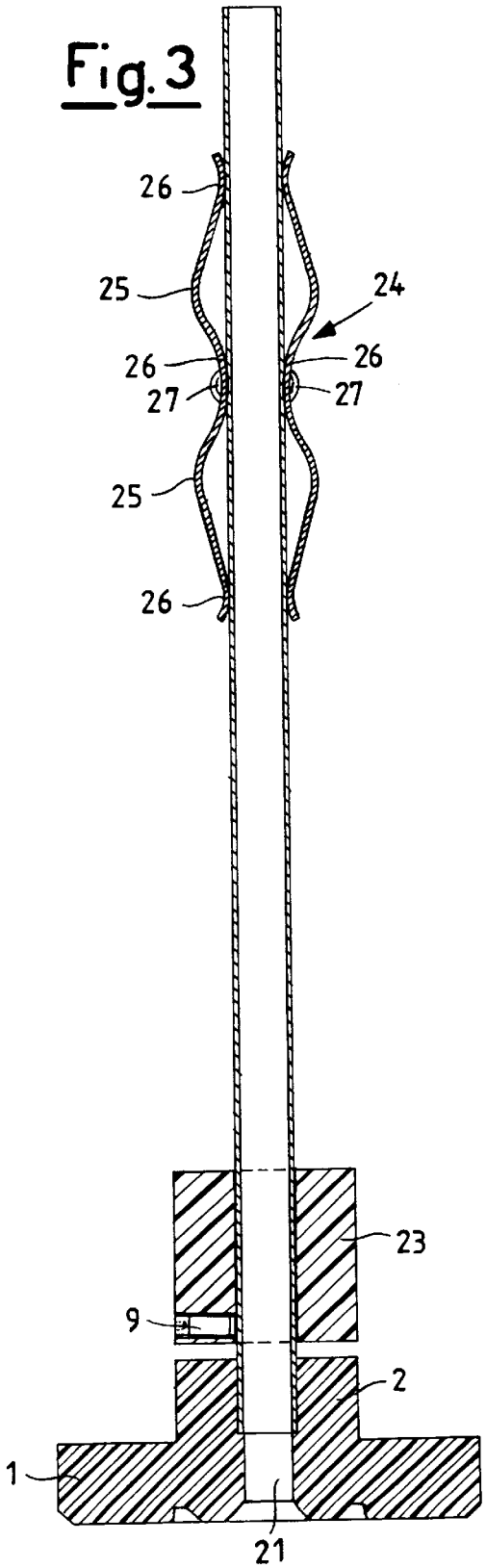
FIG. 3 is an alternative embodiment of the individual transport caddy according to the present invention.

FIG. 3 shows an alternative embodiment of the caddy of the present invention. In this embodiment the slider 23 is in the form of a cylinder, with a horizontal upper flat face on which rests the lower end of the tube, not shown in the figure. In this embodiment the diameter of the upper flat face of the slider must be substantially greater than the largest inner diameter of the tube which is to be used so as to ensure a secure flat support in all cases. The elastic centering elements 24 positioned on the upper part of the tubular peg 4 are formed as leaf springs with two or more projections 25, alternating with a plurality of recesses 26 designed to rest on the outer surface of the tubular peg 4. Each elastic centering element 24 is fixed to the peg 4 at the centre of the recess 26, for example by rivets 27 which enable the two recessed ends 26 of the leaf spring to undergo free longitudinal excursion by the effect of the inward compression of the projections 25 by the tube 6 mounted on the tubular peg 4.

FIG. 4A to 4F show alternative methods for adjusting the level of the slider 3 along the tubular peg 4.

Figure 4A:
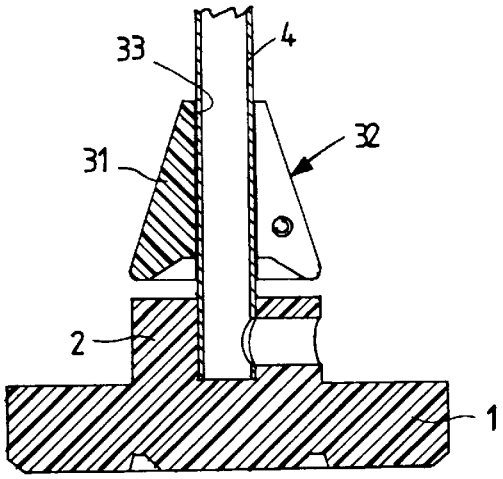
FIG. 4A is a partial cross-sectional view showing a method for adjusting the level of a slider along a tubular peg.
Figure 4B:
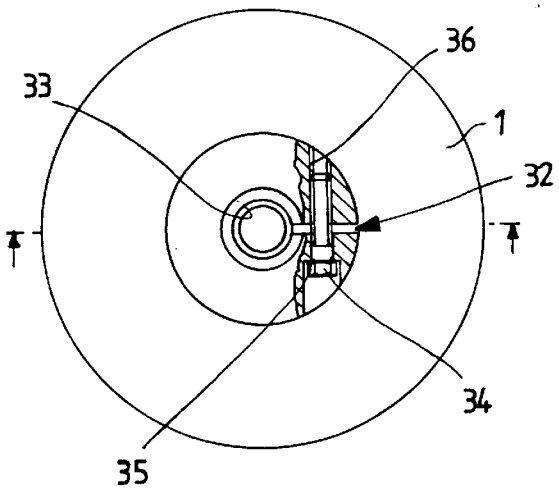
FIG. 4B is a top view of the individual transport caddy shown in FIG. 4A.
Figure 2:
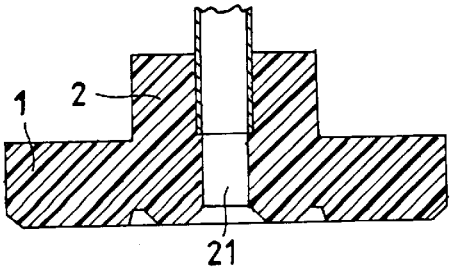
FIG. 2 is a cross-sectional view of an alternative embodiment of the present invention which includes an air passage in the lower face of the base.

FIGS. 4A and 4B show a slider in which the frusto-conical body 31 of the slider is formed with a complete vertical cut 32 along one of its generating lines, giving it a C-shape in plan view, as shown in FIG. 4B. The cut is of small thickness such that when the two trapezoidal faces of the cut are compressed one towards the other, the through hole 33 in the slider substantially contracts so that it becomes clamped against the cylindrical surface of the tubular peg 4, hence forming a coupling sleeve on the peg. This compression is achieved by one or more threaded through bolts 34 screwed into the slider body to rest on one side of the cut on a shoulder 35 in a cylindrical cavity provided in the slider body, and to engage on the other side in the thread 36 in the slider body. These members for the approach and withdrawal of the face of the cut 32 are formed preferably as metal inserts within the body of the slider, which is preferably made of plastic.

Figure 4C:
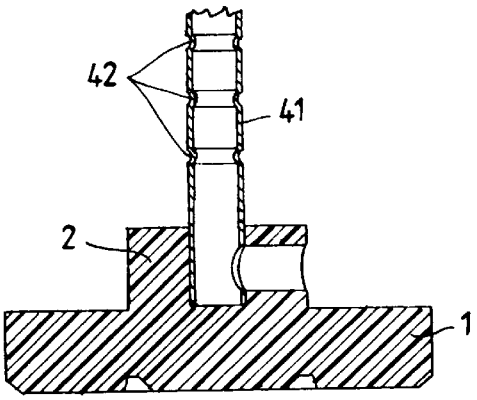
FIG. 4C is a cross-sectional view of the tubular peg having means to secure the slider thereto.
Figure 4D:
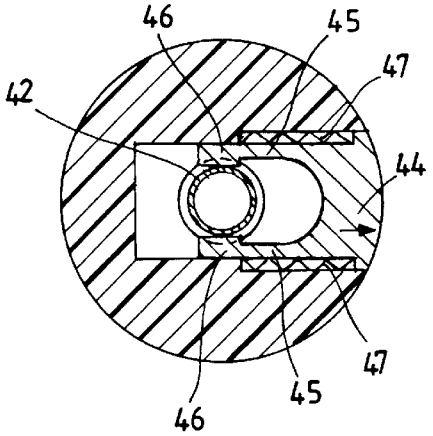
FIG. 4D is a top view of the individual transport caddy shown in FIG. 4C.
Figure 4E:
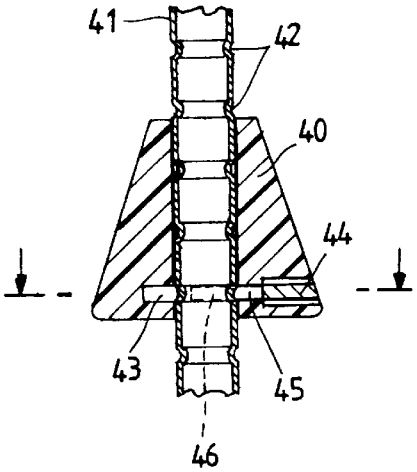
FIG. 4E is a cross-sectional view of the individual transport caddy showing the adjustable coupling of the slider and the tubular peg.

FIGS. 4C to 4F show a slider with a snap-fixing system, in which the slider 40 slides along a tubular peg 41 provided with a series of notches (hereinafter "grooves") 42 in the form of circumferential grooves provided in its outer cylindrical surface, to determine a series of slider positioning levels along the peg 41, as shown in FIG. 4C. A horizontal slot 43 is provided in the slider 40 to form a passage between its perimetral conical surface and its through bore in which the peg 41 slides, a space being left about said bore to house a locking piece 44 and allow it to slide between two alternative positions, namely a locking position and a release position.

The locking piece 44 has a U-shape, of which the two arms 45 are each provided with a final projection 46. The final projections are at a distance apart less than the outer diameter of the peg 41 and contain as an exact fit the diameter of the grooves 42, so that when the two arms assume a radially displaced position, as in FIG. 4D, the two projections couple with the grooves 42 which are at their height, as in FIG. 4E, to lock the slider 40 to the peg 41. The guide slot 43 also houses a pair of springs 47 which urge the locking piece 44 into the position for locking the slider 40, with the arms 45 pulled outwards and the two projections 46 engaging the groove 42. The travel limit of the locking piece 44 is defined by two limit stops, not shown in the figures for simplicity of the drawing.

Figure 4F:
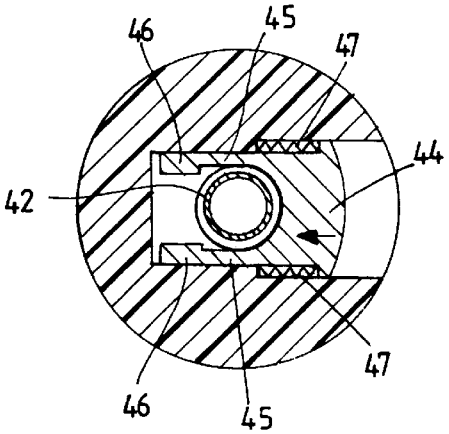
FIG. 4F is a top-view of the individual transport caddy shown in FIG. 4E.

To disengage the locking piece 44 and release the slider, the locking piece 44 is pushed inwardly, overcoming the thrust of the springs 47 as shown in FIG. 4F. The projections 46 no longer interfere with the groove 42 and the slider can be slid along the peg 41 to a different positioning level, until the thrust of the springs 47 finds a different groove 42 into which to newly insert the two projections 46 and again lock the slider 40.

It is apparent that the caddy according to the invention enables the package tube to be engaged and restrained by a series of elastic contact points distributed effectively at the two ends of the inner cylindrical surface of the tube 6, which is currently formed with a slight taper. Both the resistance of this restraint to those forces which during unwinding tend to shift the package from its vertical centered position, and its capacity for vibration damping can be previously regulated on the basis of the shape, dimensions and rigidity of the elastic elements 7, 24 for the tube which they have to carry.

The adjustability of the level of the slider 3 (or its versions 23, 31 and 40) enable the package 5 to be set for each working campaign at a constant predetermined distance from the overlying members of the winding unit, independent of the package size, within the workable range.

In automatic machines, the package must be positioned for unwinding with its yarn end 20 free and lying within its tube, from which it is withdrawn by pneumatic or mechanical effect. A very important technical aspect of the package support according to the present invention lies in the fact that this free yarn end is contained within the tubular peg 4 of the caddy instead of within the tube 6.

Generally, the yarn end available for being seized and carried to the members of the bobbin winding unit must be greater than a certain length for success to be achieved. This can be difficult if the package and its tube are too short to contain a yarn end length 20 which satisfies this requirement. Again generally, if the package and its tube are small, they are more distant from the winding members thereby requiring a longer yarn end, greater than the length available within the tube to contain it.

It is immediately apparent that the caddy of the invention overcomes this drawback both in that it enables the package, whether small or large, to be maintained at a fixed distance from the overlying winding members, and in that it provides a cavity available for the yarn end which is independent of the package format and of the length of its tube.

Secondly, if caddies are used with their pegs provided with retention springs or fins such as those available in the known art, the package yarn end is positioned within the tube and can become trapped within the springs or fins and not be easily withdrawable by suction for starting its unwinding. It is immediately apparent that the caddy of the invention overcomes this drawback in that it provides within the tubular peg 4 a cavity available for the yarn end 20 which is free of springs or projections which could cause the yarn end to jam.

Further advantages relate to the loading of the packages onto the caddy when operating by gravity fall and the new caddy has to be positioned, the package guided onto its peg and then the loaded caddy withdrawn. With caddies of the known art, there is the drawback that when the caddy is without its package, the peg is much lower than the vertical height of the caddy when loaded with a package. It is hence difficult to allow a package to fall accurately onto the caddy for which it is destined, and guide systems for the falling package have to be used which open to allow the loaded caddy to depart, and reclose to load the next caddy, with synchronization problems. With the caddy of the present invention, the overall size of the unloaded caddy is substantially equal to that of the caddy provided with its package, the loading of the caddy hence being facilitated and simplified.

We claim:

1. A caddy for transporting, positioning and processing a package in a yarn production process, the package including a tube having upper and lower parts, the caddy comprising:

a base;

a collar coupled to the base; and a mandrel coupled to the collar which engages an interior of the tube to maintain the package in a desired position, the mandrel comprising a hollow tubular peg and a package support slider coaxial with and slidably mounted on tubular peg, the package support slider being selectably locked in position on the peg so as to adjust a height of the package relative to the base.

2. The caddy for transporting, positioning and processing packages in a yarn production process as defined by claim 1, wherein the hollow tubular peg includes upper and lower parts, an exterior portion of the upper part of the hollow tubular peg including a plurality of spring elements for engaging an interior portion of the upper part of the tube.

3. The caddy for transporting, positioning and processing packages in a yarn production process as defined by claim 2, wherein the mandrel includes upper and lower tubular collars slidably mounted about the peg, the plurality of spring elements being coupled together at respective first and second ends by the upper tubular collar and the lower tubular collar and forming a spring cage, at least one of the upper and lower tubular collars sliding about the tubular peg to expand or contact the spring cage so that spring cage securely engages the interior of the tube to secure the package to the collar.

4. The caddy for transporting, positioning and processing packages in a yarn production process as defined by claim 3, wherein at least one of the upper and lower tubular collars includes means for fixedly securing the respective tubular collar to the tubular peg, and wherein the spring cage is fixed by a forced fit between the upper and lower tubular collars and the tubular peg.

5. The caddy for transporting, positioning and processing packages in a yarn production process as defined in claim 3, further comprising a plurality of rivets, wherein at least one end of the spring elements are fixedly secured to the tubular peg by the plurality of rivets which are applied to the upper tubular collar.

6. The caddy for transporting, positioning and processing packages in a yarn production process as defined by claim 1, wherein the package support slider has a conical shape having a first narrow end and a second wide end, the first narrow end engaging and centering the lower part of the tube about the hollow tubular peg.

7. The caddy for transporting, positioning and processing packages in a yarn production process as defined in claim 1, wherein the hollow tubular peg includes upper and lower parts, the upper part of the hollow tubular peg including elastic centering elements comprising leaf springs having at least two projections with a recess therebetween.

8. The caddy for transporting, positioning and processing packages in yarn production process as defined by claim 1, wherein the support slider includes a compression bolt for adjustably securing the support slider to the tubular peg.

9. The caddy for transporting, positioning and processing packages in a yarn production process as defined by claim 1, the tubular peg having a plurality of notches which define a plurality of positions of the slider along the tubular peg, the slider having a slot for housing a locking piece which selectably engages at least one of the plurality of notches for selectably securing the slider at one of the plurality of positions along the peg.

10. The caddy for transporting, positioning and processing packages in a yarn production process as defined by claim 9, wherein the locking piece is U-shaped having first and second arms which comprise terminal projections which are spaced apart from one another less than an outer diameter of the peg and which have a diameter which substantially conforms to the diameter of the grooves.

11. The caddy for transporting, positioning and processing packages in a yarn production process as defined by claim 10, the slider further comprising a guide slot that houses springs which urge the locking piece into locking engagement with the grooves on the peg.

12. The caddy for transporting, positioning and processing packages in a yarn production process as defined by claim 1, wherein the base has a cylindrical disc-shape and the collar has a cylindrical shape.

* * * * *